United States Patent [19]

Badura

[11] 4,034,503

[45] July 12, 1977

[54] PEG TOP SPINNER

[76] Inventor: Peter Badura, Im alten Garten 2, 55 Trier - Tarforst, Germany

[21] Appl. No.: 652,902

[22] Filed: Jan. 28, 1976

[30] Foreign Application Priority Data

Feb. 11, 1975 Germany ..... 2505632

[51] Int. Cl.[2] ..... A63H 1/02

[52] U.S. Cl. ..... 46/241; 46/65; 46/70

[58] Field of Search ..... 46/64, 67, 70, 241, 46/269

[56] References Cited

U.S. PATENT DOCUMENTS

| | | | |
|---|---|---|---|
| 2,305,019 | 12/1942 | Madar | 46/67 |
| 3,254,446 | 6/1966 | Endris | 46/269 |

*Primary Examiner*—John F. Pitrelli
*Assistant Examiner*—Robert F. Cutting
*Attorney, Agent, or Firm*—Robert W. Beach; R. M. Van Winkle

[57] ABSTRACT

In a children's peg top including a top body having a tip whereon it can spin, an axial recess is provided in the end of the top body remote from the tip. A magnetic element carried in such recess cooperates with a magnetic element on a spinner body so that the spinner body is separably held magnetically in the top body recess. One end of each of two cord lengths is connected to the spinner body. Such cord lengths can be twisted together and then caused to untwist by drawing their free ends apart thereby rotating the spinner and top bodies.

4 Claims, 1 Drawing Figure

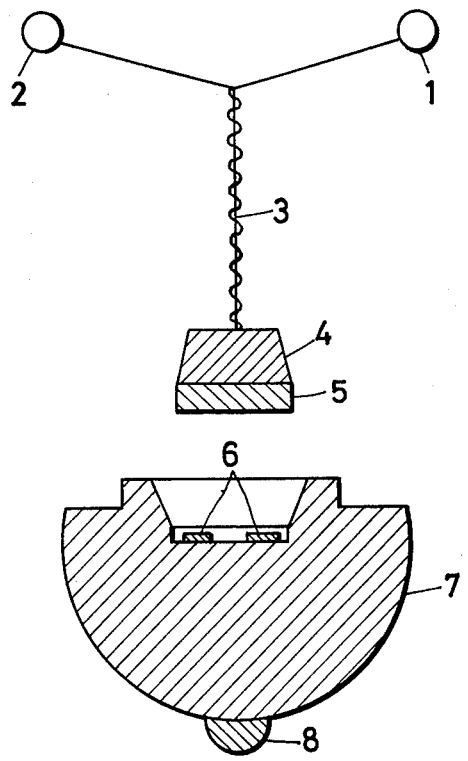
2
1
3
4
5
6
7
8

PEG TOP SPINNER

BACKGROUND OF THE INVENTION

1. Field of the Invention

The present invention relates to means for driving children's peg tops of the kind comprising top bodies in the form of bodies of rotation having tips whereon such bodies can spin.

2. Prior Art

One form of peg top is known in which one end of a cord carriers a magnet whereby such cord is detachably connected to a top body. The cord can be wound about the top body and used to apply rotational drive for initiating spinning of the top body, for example, by throwing the top body while holding the free end of the cord so that the cord is unwound from the top body and causes such body to rotate. When the cord has finished unwinding, the magnet detaches from the top body. The principal objection to such peg tops is that one cannot rewind the cord about the top body to impose further rotational drive until the top body has stopped spinning.

SUMMARY OF THE INVENTION

The principal object of the present invention is to provide a novel peg top which is adapted to be rotated by use of cords which can be connected to the top body while the latter is spinning to enable further rotational drive to be imparted thereto in a simple and convenient manner.

This object can be accomplished by providing a peg top including a top body having a tip whereon such body can spin, a complementary spinner body by which rotational drive may be applied to the top body, two cord lengths connected to the spinner body, and cooperating magnetic means on the top body and on the spinner body for separably retaining the spinner body on the end of the top body remote from its tip.

The magnetic means advantageously includes a permanent magnet carried by the spinner body and one or more magnetic elements, for example, a ferromagnetic ring or one or more ferromagnetic pins, carried in a recess in the top body, which recess is shaped for receiving the permanent magnet therein.

BRIEF DESCRIPTION OF THE DRAWING

The single FIGURE is a diagrammatic axial section through a preferred embodiment of the peg top of the present invention.

DETAILED DESCRIPTION

The preferred embodiment of the present invention is shown in the drawing. A solid top body 7, in the form of a body of revolution, has a tip 8 disposed on its axis. Formed in the end of the top body remote from the tip is a frustoconical axial recess. A magnetic element or elements, that is, a magnet-attractable element or elements, in the form of a ferromagnetic pins 6 are disposed in the bottom of the recess. Such ring or pins could be made of iron. Complementary to the top body 7 is a spinner body 4 by which rotational drive can be applied to the top body. The spinner body is shown as being a disc-shaped body of revolution, or a body of circular cross section, which will fit into the frustoconical recess in the top body. On the lower end of the spinner body is a disc-shaped permanent magnet 5 which will reach to the bottom of the recess to cooperate with the ring or pins 6. With this arrangement the spinner body 4 is detachably retained on the top body 7.

Connected to the spinner body are two cord lengths 3 having respective knobs or grips 1, 2 on their free ends.

To initially spin the top body 7, the spinner body 4 is inserted into the recess where it is retained by magnetic attraction between magnet 5 and the ring or pins 6. The grips 1, 2 are held stationary while the two bodies are rotated so that the two cords 3 become twisted together as shown in the drawing. After sufficient twisting of the cords has been effected, the bodies are freed and a user, holding a grip 1, 2 in each hand, draws the grips apart. As a result, a substantial untwisting force is applied to the cords, and this force is transmitted through the spinner body 4 to the body 7; rotational drive is applied to the top body, and a very high spinning speed can be effected.

Once the cords have reached a fully untwisted condition, the rotational motion of the top body attempts to start retwisting the cords in a direction opposite to that in which they were previously twisted. As long as separating force is applied to the cords by the user such retwisting is resisted. As a result the attracting force of the magnet 5 on the ring or pins 6 is exceeded by the forces imposed upon the spinner body 4 through the cords, and the top body separates from the spinner body and continues to spin on its tip 8.

If the top body is allowed to come to rest, it can be spun again by repeating the operations described above. However, the manual winding together of the cords 3 can be avoided by reconnecting the spinner body 4 to the top body 7 while the latter is still spinning and then letting the cords become twisted together by the conjoint rotation of the spinner and top bodies. This can be done quite easily by holding grips 1, 2 and suspending the spinner body 4 over the spinning top body 7 until it is aligned with the recess, whereupon lowering of the cords 3 and the spinner body 4 causes the latter to drop into the recess and thereupon be reengaged with the top body 7 for conjoint rotation with it.

It should be understood that, following such reengagement, the speed of rotation of the top body 7 will be decreasing while the cords are being retwisted, and that the cords should be held relatively slack to permit the retwisting to occur. To impart rotational drive anew to the top body 7, the grips 1, 2 can be drawn apart again to impose untwisting forces on the cords, gently at first to ensure that the top body first slows down and then reverses its direction of rotation to correspond with the new unwinding direction of the cords to avoid causing the release of the spinner body from the top body.

It will be appreciated that in this way the user can keep the top body rotating alternately in opposite directions in a manner which for all practical purposes may be regarded as being continuous.

The top and spinner bodies may conveniently be made of wood or plastic, with the exception, of course, of the magnet 5 and the ferromagnetic ring or pins 6. It should be understood that, although in the illustrated embodiment the magnetic elements are arranged with the magnet on the spinner body and the complementary magnet-attractable element or elements on the top body, the arrangement can easily be reversed with the magnet provided on the top body and the complementary magnet-attractable element or elements on the spinner body. The complementary element or elements do not have to be a ring or pins 6 and may take any practical form.

I claim:

1. In a peg top including a top body having a tip on which the top body can spin, the improvement comprising spinner means for applying rotational drive to the top body including a spinner body having an upper end, twistable cord means attached to said spinner body upper end for imparting rotational force to said spinner body by untwisting of said cord means and magnetic means for detachably connecting said spinner body and a portion of the top body remote from its tip for imparting spinning of said spinner body to spin the top body followed by detachment of said spinner body from the top body and for thereafter reconnecting said spinner body to the top body while the top body continues spinning on its tip for imparting rotation of the top body to said spinner body to retwist said cord means.

2. In the peg defined in claim 1, the magnetic means including a permanent magnet carried by one of the bodies and a magnet-attractable element carried by the other body for cooperation with said permanent magnet.

3. In the peg top defined in claim 1, the spinner body having a lower end, the twistable cord means including two cord lengths each of which lengths has one end attached to the upper end of the spinner body, the top body having a frustoconical axial recess in the end thereof remote from its tip with a cross section larger than the cross section of the spinner body between its ends for receiving said lower end of the spinner body loosely therein, and the magnetic means including cooperating components one carried by said lower end of the spinner body and the other component being carried by the top body in the bottom of said top body recess.

4. The method of applying rotational drive to a peg top including a top body having a tip on which the top body can spin and a spinner body having twistable cord means attached to the spinner body upper end, one of such bodies carrying a permanent magnet and the other of such bodies carrying a magnet-attractable element, which method comprises detachably connecting the spinner body and a portion of the top body remote from its tip by attraction of the permanent magnet and the magnet-attractable element, twisting the twistable cord means, untwisting such cord means and thereby effecting conjoint spinning of the spinner body and the top body in a given direction followed by detachment of the spinner body from the top body to free the top body for continued spinning of the top body in such given direction, thereafter reconnecting the spinner body to the top body by attraction of the permanent magnet and the magnet-attractable element while the top body continues spinning on its tip in such given direction and thereby imparting rotation of the top body to the spinner body and twisting the cord means in the direction opposite to its initial direction of twist, and subsequently untwisting the cord means for effecting spinning of the spinner body and the top body in the direction opposite such given direction and detaching the spinner body from the top body to free the top body for continued spinning in such opposite direction.

* * * * *